US010500704B2

(12) United States Patent
Yu et al.

(10) Patent No.: US 10,500,704 B2
(45) Date of Patent: Dec. 10, 2019

(54) STAPLER

(71) Applicant: NINGBO DELI BINDING EQIPMENT CO., LTD, Zhejiang (CN)

(72) Inventors: Jiehui Yu, Zhejiang (CN); Rongjie Liu, Zhejiang (CN)

(73) Assignee: Ningbo Deli Binding Equipment Co., Ltd, Zhejiang (CN)

( * ) Notice: Subject to any disclaimer, the term of this patent is extended or adjusted under 35 U.S.C. 154(b) by 345 days.

(21) Appl. No.: 15/327,707

(22) PCT Filed: Dec. 10, 2015

(86) PCT No.: PCT/CN2015/097057
§ 371 (c)(1),
(2) Date: Jan. 20, 2017

(87) PCT Pub. No.: WO2016/091197
PCT Pub. Date: Jun. 16, 2016

(65) Prior Publication Data

US 2017/0203426 A1 Jul. 20, 2017

(30) Foreign Application Priority Data

Dec. 11, 2014 (CN) ..... 2014 1 0754609

(51) Int. Cl.
*B25C 5/02* (2006.01)
*B25C 5/16* (2006.01)
*B25C 5/11* (2006.01)

(52) U.S. Cl.
CPC ..... *B25C 5/025* (2013.01); *B25C 5/11* (2013.01); *B25C 5/1617* (2013.01)

(58) Field of Classification Search
CPC ..... B25C 5/11; B25C 5/025; B25C 5/1617; B25C 5/0242; B25C 5/0221
See application file for complete search history.

(56) References Cited

U.S. PATENT DOCUMENTS 2,511,003 A * 6/1950 Peterson ..... B25C 5/025 227/134
5,497,932 A * 3/1996 Brewer ..... B25C 5/11 227/132

(Continued)

FOREIGN PATENT DOCUMENTS

CN 201201376 Y 3/2009
CN 103406878 A 11/2013

(Continued)

OTHER PUBLICATIONS

International Search Report for corresponding International Application No. PCT/CN2015/097057 dated Mar. 16, 2016.

(Continued)

*Primary Examiner* — Alexander M Valvis
*Assistant Examiner* — Thomas M Wittenschlaeger
(74) *Attorney, Agent, or Firm* — Renner, Otto, Boisselle & Sklar, LLP

(57) ABSTRACT

A stapler comprises a base (1), a staple pin track (2), a top blade assembly (3), a hinge (4) and an upper cover (5). Tail ends of the staple pin track, the top blade assembly and the upper cover are all hingedly connected to a tail end of the base. A first guide part is disposed on a side wall of the upper cover, and one end of the hinge is slidably connected to the first guide part. The first guide part is set in a structure that when the upper cover is pressed, one end of the hinge can move to the tail end of the upper cover and press downwards. A second guide part is disposed on the side wall of the base, and the other end of the hinge is slidably connected to the second guide part. The second guide part is set in a structure that when the upper cover is pressed, the other end of the hinge can move to a front end of the base, and when the upper cover is opened, the other end of the hinge is separated from the base. A middle part of the hinge is hingedly connected to a middle of the top blade assembly, (Continued)

and the first guide part is close to the tail end of the upper cover. The present invention has a good labor-saving effect and makes it convenient to put in staple pins.

10 Claims, 12 Drawing Sheets

(56) References Cited

U.S. PATENT DOCUMENTS 5,699,949 A * 12/1997 Marks ..... B25C 5/085 227/132
6,145,728 A * 11/2000 Marks ..... B25C 5/11 227/120
7,431,186 B2 * 10/2008 Hsu ..... B25C 5/0242 227/120
7,665,643 B2 * 2/2010 Huang ..... B25C 5/0242 227/128
8,899,136 B2 * 12/2014 Zhu ..... B26D 5/10 83/524
2007/0221699 A1 * 9/2007 Hsu ..... B25C 5/0242 227/134
2009/0184150 A1 * 7/2009 Tsai ..... B25C 5/0221 227/134
2010/0243701 A1 * 9/2010 Yu ..... B25C 5/0242 227/129
2010/0264190 A1 * 10/2010 Tsai ..... B25C 5/025 227/128
2014/0367442 A1 * 12/2014 Gadekar ..... B25C 5/11 227/82
2015/0158162 A1 * 6/2015 Dhillon ..... B25C 5/11 227/132

FOREIGN PATENT DOCUMENTS

CN 203920074 U 11/2014
CN 104476502 A 4/2015
CN 204295641 U 4/2015
DE 102008012519 A1 * 9/2009
TW 201038371 A 11/2010

OTHER PUBLICATIONS

Written Opinion of the International Searching Authority for corresponding International Application No. PCT/CN2015/097057 dated Mar. 16, 2016.

* cited by examiner

STAPLER

This application is a national phase of International Application No. PCT/CN2015/097057 filed Dec. 10, 2015, and claims priority to Application No. CN EP 201410754609.8 filed Dec. 11, 2014.

TECHNICAL FIELD

The present invention relates to a stapler.

BACKGROUND

The patent application (Publication No.: CN102335903A) discloses a labor-saving stapler, which is added with an auxiliary upper cover and realizes labor-saving operation with a double-lever principle. However, because the lower end of the auxiliary upper cover is hinged at the front end of a base and the upper end of the auxiliary upper cover is slidably connected into a first slide slot of an upper cover through a first transmission pin, in such case, the lower end of the auxiliary upper cover cannot move while a second transmission pin on a staple-pressing plate is located at a position close to the front end of the staple-pressing plate, thereby the upper end of the auxiliary upper cover and the first slide slot are located approximately the middle position of the upper cover, as a result, as the upper cover is pressed down, the resisting arm of the upper cover is long, and consequently, an optimal labor-saving effect cannot be achieved; and moreover, the opening angle of the upper cover is small, so it is inconvenient to put staples into a staple pin track.

A staple-mounting mechanism of an existing stapler comprises an upper blade holder, an external staple pin track, an internal staple pin track, a staple pusher, a staple pusher spring, and a long pin; the long pin is arranged in the external staple pin track, and is fixed at both ends of the external staple pin track; the staple pusher sleeves the long pin, and is arranged in the external staple pin track; the rear end of the staple pusher is connected to the front end of the staple pusher spring, the rear end of the staple pusher spring is connected to the rear end of the staple pin track; staples are mounted between the front end of the staple pusher and the front end of the external staple pin track, the staple pusher in the staple pin track is limited and pushed by the spring at the rear end of the staple pusher, and the staples can be pushed out by the staple pusher. Therefore, the quantity of the mounted staples between the front end of the staple pusher and the front end of the staple pin track is limited by the position of the staple pusher. Since the staple pusher spring can produce elastic force when compressed, a user has to open an upper blade and press the staple pusher with one hand in order to successfully mount the staples with the other hand when mounting the staples, and therefore, not only is it inconvenient to mount the staples, but also the quantity of the mounted staples is reduced due to the affection of the resilience force of the spring on the staple pusher.

SUMMARY

The technical problem which needs to be solved by the present invention is to provide a stapler which has a good labor-saving effect and in which staples can be placed conveniently.

In order to solve the above technical problem, the present invention provides a stapler, comprising a support base, a staple pin track, a top blade assembly, a hinge, and an upper cover; wherein the tail ends of the staple pin track, the top blade assembly and the upper cover are all hingedly connected to the tail end of the support base; a first guide part is disposed on a side wall of the upper cover, one end of the hinge is slidably connected to the first guide part, the first guide part is set in a structure that when the upper cover is pressed, one end of the hinge can move to the tail end of the upper cover and press downward; a second guide part is disposed on the side wall of the support base, the other end of the hinge is slidably connected to the second guide part, the second guide part is set in a structure that when the upper cover is pressed, the other end of the hinge can move to the front end of the support base, and when the upper cover 5 is opened, the other end of the hinge is separated from the support base; and a middle part of the hinge is hingedly connected to a middle of the top blade assembly.

As a preferred solution, the first guide part is close to the tail end of the upper cover.

As a preferred solution, the tail ends of the staple pin track, the top blade assembly and the upper cover are all hingedly connected to the support base through the same pin shaft.

As a preferred solution, the first guide part is a first slide slot, the first slide slot extends in the length direction of the upper cover, and one end of the hinge is slidably connected into the first slide slot through a pin shaft.

As a preferred solution, the first guide part is a first slide slot, and one end of the hinge is slidably connected into the first slide slot through a pin shaft.

As a preferred solution, the second guide part comprises a second slide slot and a third slide slot, the second slide slot extends in the horizontal direction, the third slide slot obliquely and downwardly extends from the upper end surface of the side wall of the support base and communicates with one end of the second slide slot which is closer to the tail end of the support base, the upper end of the third slide slot is open, the angle between the second slide slot and the third slide slot is obtuse, and the other end of the hinge is slidably connected into the second slide slot and the third slide slot through a hinge shaft.

As a preferred solution, the second guide part is a notch, the opening of which is directed to the backward direction, so that the manufacturing of which is much easier.

As a preferred solution, a hinge-positioning mechanism is arranged between the hinge and the top blade assembly, so that the other end of the hinge can be accurately aimed at the opening of the second guide part, and thereby the front end of the hinge can be guided into the second guide part.

As a preferred solution, the hinge-positioning mechanism is as follows: a front hinge-positioning portion is provided in the middle part of an top blade, a rear hinge-positioning portion is provided in the tail of the hinge, and the ends of a tension spring are respectively fixed between the front hinge-positioning portion and the rear hinge-positioning portion.

As a preferred solution, a staple-mounting mechanism comprises a top blade holder, an external staple pin track, an internal staple pin track, a staple pusher, a staple pusher spring, and a long pin; the long pin is arranged in the external staple pin track, and is fixed at both ends of the external staple pin track; the staple pusher sleeves the long pin, and is arranged in the external staple pin track; the rear end of the staple pusher is connected to the front end of the staple pusher spring, the rear end of the staple pusher spring is connected to the rear end of the staple pin track, staples are mounted between the front end of the staple pusher and the front end of the external staple pin track; the internal staple pin track is connected to the staple pusher through a connecting part; a positioning mechanism is arranged between the tail of the top blade and the tail of the support base, and when the top blade leaves from the staple pin track to mount the staples until the maximum extension position, the top blade and the support base are locked by the positioning mechanism.

Since the top blade is locked by means of the positioning mechanism, the staple pusher can be positioned at the maximum stapling position by overcoming the spring force when stapling is operated.

As a preferred solution, the positioning mechanism is as follows: a protruding or hole is provided in the tail of the support base, and a corresponding hole or protruding is provided in the tail of the top blade holder.

Compared with the prior art, the present invention has the following advantages: because a first slide slot is relatively close to the tail end of an upper cover, as the upper cover is pressed down for stapling, the resisting arm of the upper cover is short, so the labor-saving effect is good; moreover, when staples need to be put into a staple pin track, the upper cover can be opened by a large angle, and thus the staples can be conveniently put into the staple pin track.

DETAILED DESCRIPTION

Figure 1:
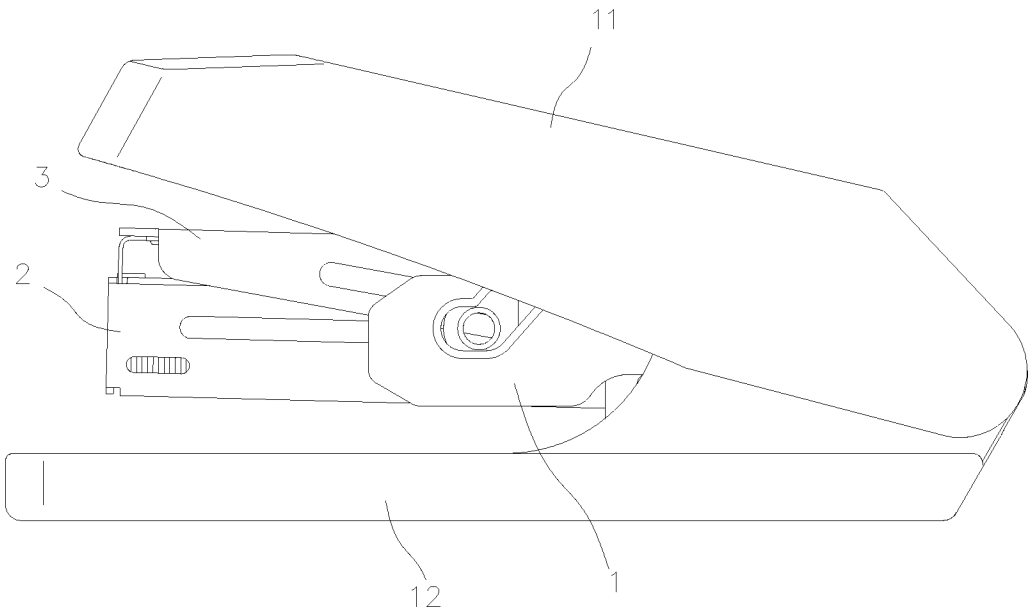
FIG. 1 is a structural schematic diagram of an embodiment 1 of the present invention.
Figure 2:
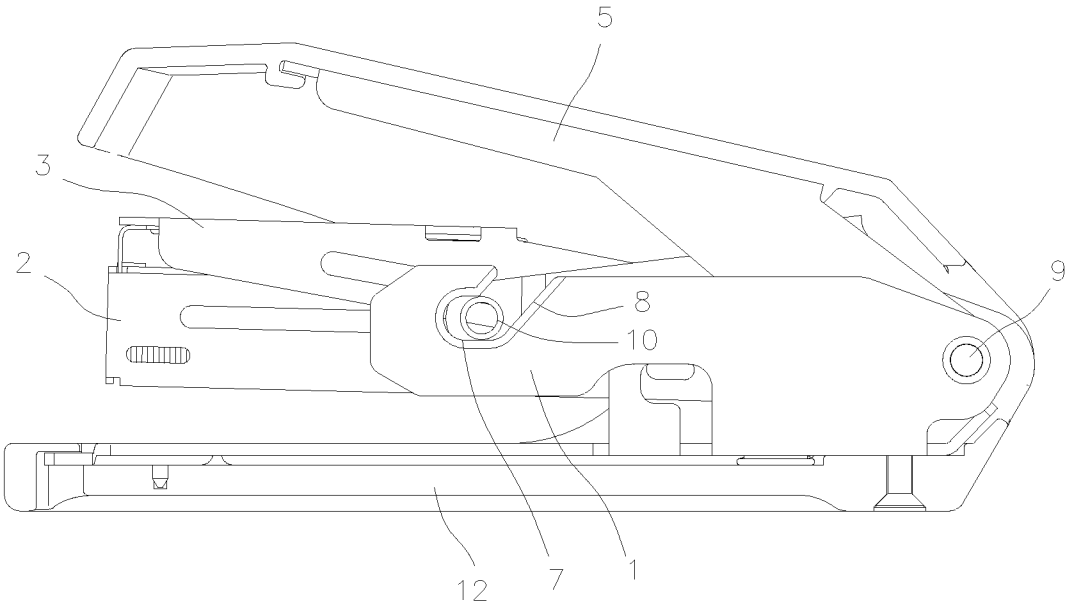
FIG. 2 is a partial sectioned view of FIG. 1.
Figure 3:
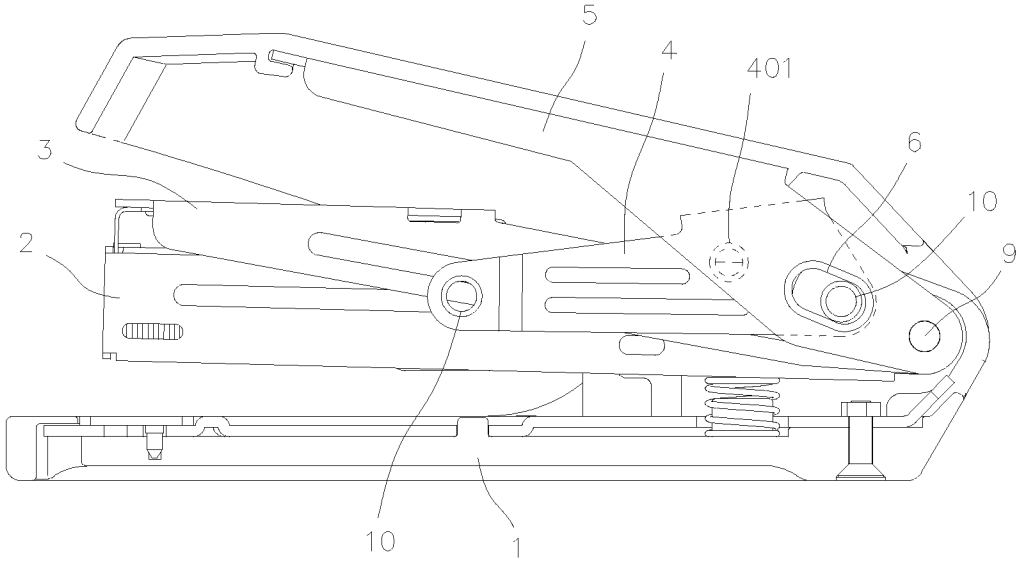
FIG. 3 is a structural schematic diagram after the support base in FIG. 2 is removed.
Figure 4:
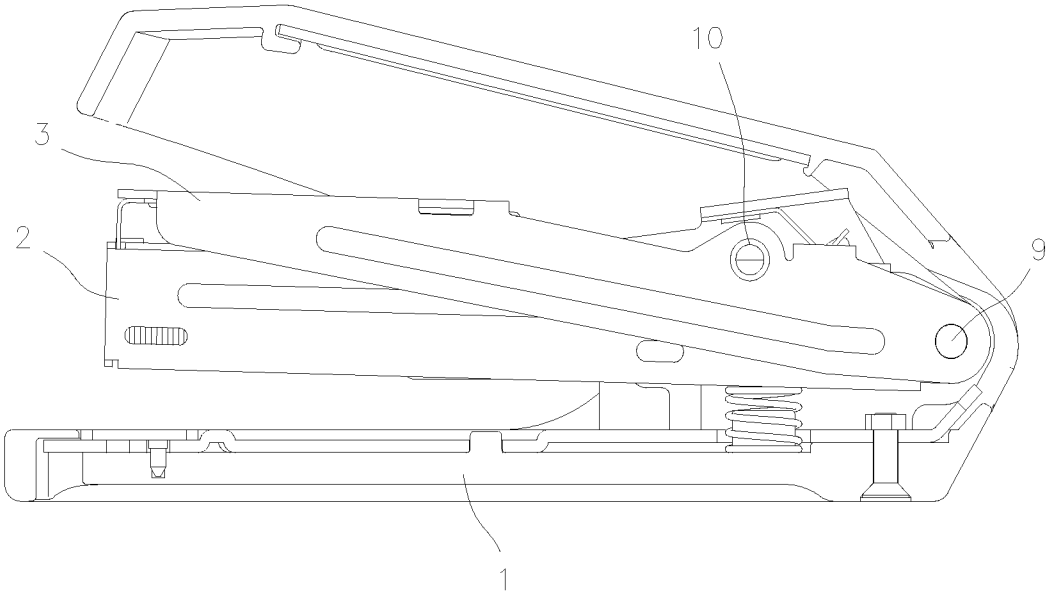
FIG. 4 is a structural schematic diagram after the upper cover and the hinge in FIG. 3 are removed.

The present invention is further described hereinafter with reference to the drawings and the preferred embodiments.

Embodiment 1

As shown in FIG. 1 to FIG. 5, a stapler of the present invention comprises a support base 1, a staple pin track 2, a top blade assembly 3, a hinge 4, and an upper cover 5; the tail ends of the staple pin track 2, the top blade assembly 3 and the upper cover 5 are all hingedly connected to the tail end of the support base 1, so that the staple pin track 2, the top blade assembly 3 and the upper cover 5 can all be revolved relative to the support base 1; a first guide part is disposed on a side wall of the upper cover 5, and one end of the hinge 4 is slidably connected to the first guide part, and the first guide part is set in a structure that when the upper cover 5 is pressed, one end of the hinge 4 can move to the tail end of the upper cover 5 and press downwards.

As a preferred solution, the first guide part is a first slide slot 6, the first slide slot 6 extends in the length direction of the upper cover 5, the length direction of the upper cover 5 means a direction from a hinging hole of the tail end of the upper cover 5 to the front edge of the front end of the upper cover 5. One end of the hinge 4 is slidably connected into the first slide slot 6 through an hinged shaft 10, consequently, since the first slide slot 6 extends in the length direction of the upper cover 5, when the upper cover 5 is pressed, the hinged shaft 10 in the first slide slot 6 can move fast toward the tail end of the upper cover 5, so that the resisting arm can be reduced rapidly when the upper cover 5 is pressed, and thereby, the further the upper cover 5 is pressed down, the better the labor-saving effect is.

Of cause, the first guide part can also be of other structures, for example, a slide way is arranged on the internal surface of the side wall of the upper cover 5, and one end of the hinge 4 is slidably connected into the slide way through a hinged shaft 10; of cause, the slide way is arranged on the internal surface of the side wall of the upper cover 5, and one end of the hinge 4 can also be slidably connected into the slide way through a roller.

A second guide part is disposed on the side wall of the support base 1, and the other end of the hinge 4 is slidably connected to the second guide part, and the second guide part is set in a structure that when the upper cover is pressed, the other end of the hinge 4 can move to a front end of the support base 1, and when the upper cover 5 is opened, the other end of the hinge 4 is separated from the support base 1.

As a preferred solution, the second guide part comprises a second slide slot 7 and a third slide slot 8, the second slide slot 7 extends in the horizontal direction, the third slide slot 8 obliquely and downwardly extends from the upper end surface of the side wall of the support base 1 and communicates with one end of the second slide slot 7 which is closer to the tail end of the support base 1, the upper end of the third slide slot 8 is open, the angle between the second slide slot 7 and the third slide slot 8 is obtuse. The other end of the hinge 4 is slidably connected into the second slide slot 7 and the third slide slot 8 through a hinged shaft 10, and thus, when the upper cover 5 is pressed, the hinged shaft 10 of the other end of the hinge 4 can slide in the second slide slot 7 toward the front end of the support base 1.

When staples need to be mounted into the staple pin track 2, the upper cover 5 is pulled upward, and the hinge 4 is drove to move upward by the upper cover 5, at this moment, the hinged shaft 10 of the other end of the hinge 4 can slide upward along the third slide slot 8, moreover, the hinged shaft 10 can slide out from the opening of the upper end of the third slide slot 8. Consequently, the upper cover 5 can be freely pulled upward without the limit of the hinge 4, thereby the upper cover 5 can be opened by a large angle, and thus the staples can be conveniently put into the staple pin track 2.

Of cause, the second guide part can also be of other structures, for example, a slide way is arranged on the internal surface of the side wall of the support base 1, and the other end of the hinge 4 is slidably connected into the slide way through a hinged shaft 10; of cause, the slide way is arranged on the internal surface of the side wall of the support base 1, and the other end of the hinge 4 can also be slidably connected into the slide way through a roller.

A middle part of the hinge 4 is hingedly connected to a middle of the top blade assembly 3, that is, a hinged shaft 10 is disposed on the side wall of the top blade assembly 3, a hinged hole 401 is disposed on the side wall of the hinge 4, and the hinged shaft 10 is rotatably connected into the hinged hole 401.

The tail ends of the staple pin track 2, the top blade assembly 3 and the upper cover 5 are all handedly connected to the tail end of the support base 1 through the same pin shaft 9, consequently, as the upper cover 5 is pressed down, the force-applying arm of the upper cover 5 is long, and thereby the labor-saving effect is better.

Figure 5:
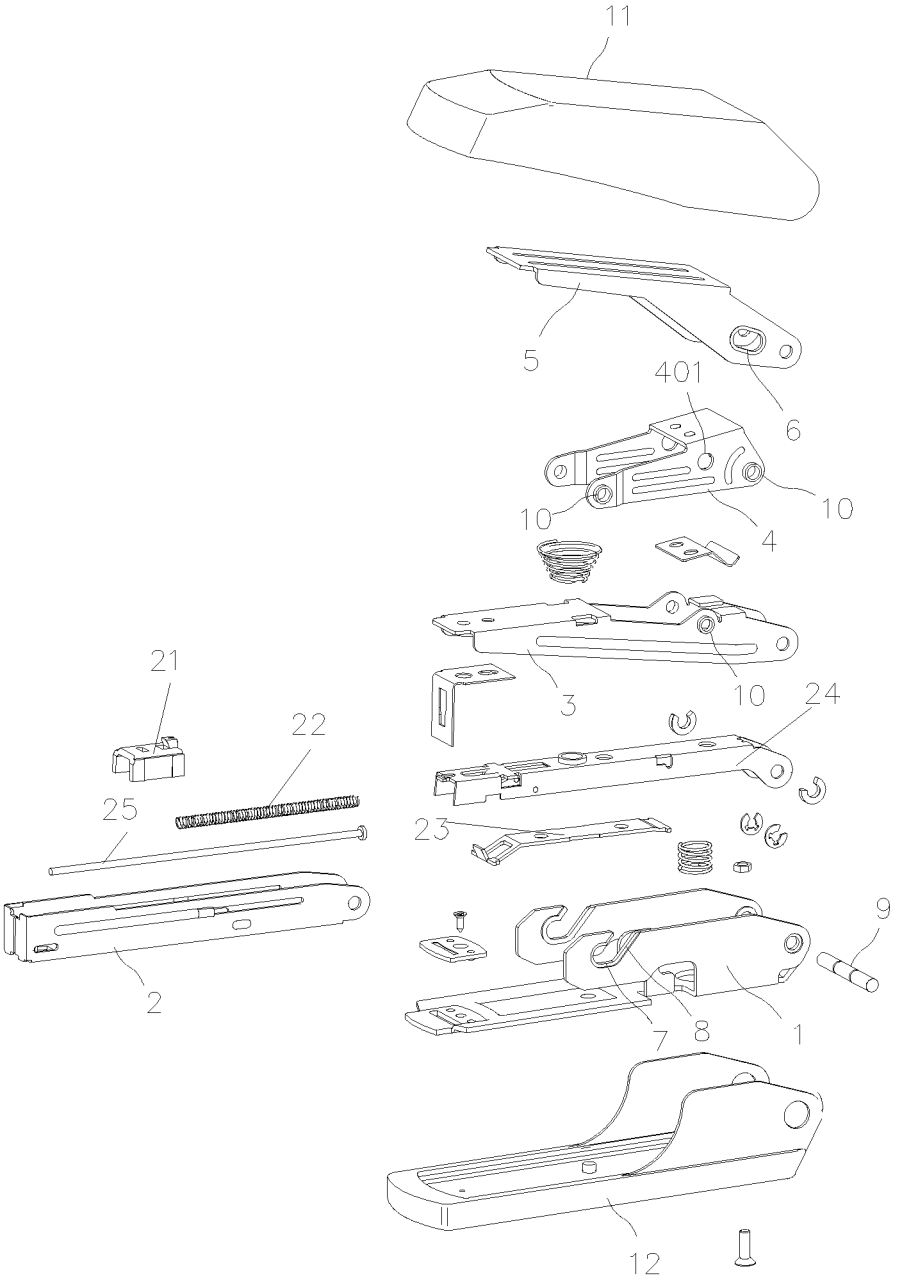
FIG. 5 is an exploded diagram of embodiment 1 of the present invention.

Refer to FIG. 5, the upper cover 5 is arranged in a plastic cover 11, and the support base 1 is fixed on a plastic base 12.

The structure of one side of the stapler is described in the above-mentioned embodiment. In fact, the structures of both sides of the stapler are arranged symmetrically, that is, the other side of the stapler is symmetrically provided with the same structure.

When the stapler of the present invention is in use, the front end of the upper cover 5 is pressed down, at this moment, the hinge 4 is pressed down, moreover, the hinged shafts 10 of one end of the hinge 4 slide downward along the first slide slots 6, and meanwhile, the hinge shafts 10 of the other end of the hinge 4 move along the second slide slots 7 in a direction toward the front end of the support base 1; while the hinge 4 is pressed down, the hinge 4 presses down the top blade assembly 3 by means of the hinged shafts 10 on the top blade assembly 3, the top blade assembly 3 presses out a staple from staples in the staple pin track 2, and thereby stapling is completed.

Embodiment 2

Figure 6:
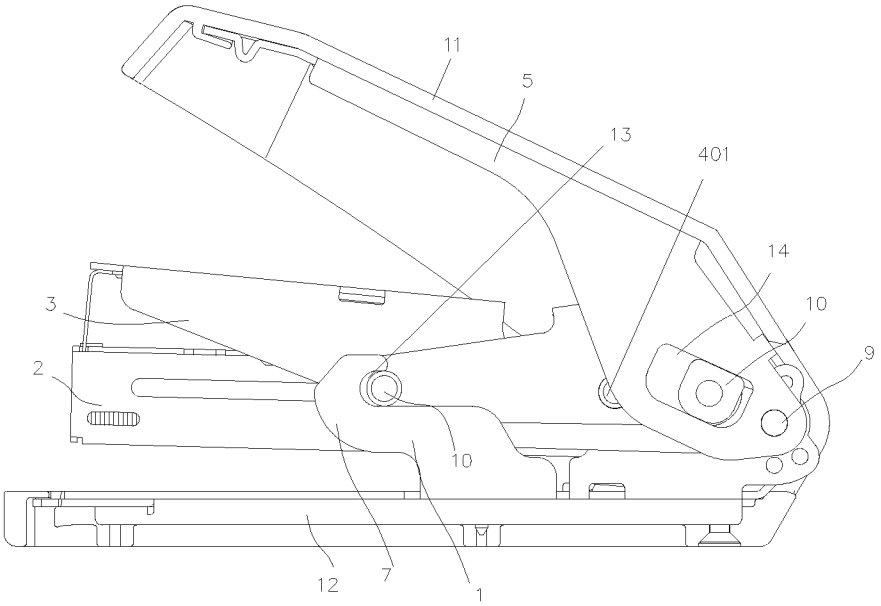
FIG. 6 is a structural schematic diagram of an embodiment 2 of the present invention.

As shown in FIG. 6, the stapler comprises a support base 1, a staple pin track 2, an top blade assembly 3, a hinge 4, and an upper cover 5; the tail ends of the staple pin track 2, the top blade assembly 3 and the upper cover 5 are all hingedly connected to the tail end of the support base 1, so that the staple pin track 2, the top blade assembly 3 and the upper cover 5 can all be revolved relative to the support base 1; a first guide part is disposed on a side wall of the upper cover 5, one end of the hinge 4 is slidably connected to the first guide part, and the first guide part is set in a structure that when the upper cover 5 is pressed, one end of the hinge 4 can move to the tail end of the upper cover 5 and press downward.

The first guide part is a first slide slot 14, and one end of the hinge 4 is slidably connected into the first slide slot 14 through a hinged shaft 10. As the upper cover 5 is pressed down, the hinged shaft 10 in the first slide slot 14 moves fast toward the tail end of the upper cover 5, so that the resisting arm is reduced as the upper cover 5 is pressed down, and thereby, the further the upper cover 5 is pressed down, the better the labor-saving effect is.

Apparently, the slide slot in the first guide part may also be changed into a slide way, and a roller may take the place of the hinged shaft to be slidably connected into the slide way.

A second guide part is disposed on the side wall of the support base 1, and the other end of the hinge 4 is slidably connected to the second guide part.

As shown in FIG. 6, the second guide part is a long notch 13, the opening of which is directed to the direction of the tail of the stapler, and the hinged shaft 10 of the front part of the hinge 4 is arranged in the long notch 13; as the upper cover 5 is pressed down, the other end of the hinge 4 can move toward the front end of the support base 1; moreover, during normal use, the hinged shaft 10 is always arranged in the long notch 13; and when the upper cover 5 is opened, the hinged shaft 10 of the hinge 4 can get away from the long notch 13 of the support base 1, thereby separate from the support base 1.

When staples need to be mounted into the staple pin track 2, the upper cover 5 is pulled upward, and the hinge 4 is drove to move upward by the upper cover 5, at this moment, the hinged shaft 10 of the other end of the hinge 4 upwardly slides out of the opening of the long notch 13 along the long notch 13. Consequently, the upper cover 5 can be freely pulled upward without the limit of the hinge 4, thus the upper cover 5 can be opened by a large angle, and thereby the staples can be conveniently put into the staple pin track 2.

Apparently, the slide slot in the second guide part may also be changed into a slide way, and a roller may take the place of the hinged shaft to be slidably connected into the slide way.

A middle part of the hinge 4 is hingedly connected to a middle of the top blade assembly 3, that is, a hinged shaft 10 is disposed on the side wall of the top blade assembly 3, a hinged hole 401 is disposed on the side wall of the hinge 4, and the hinged shaft 10 is rotatably connected into the hinged hole 401.

The tail ends of the staple pin track 2, the top blade assembly 3 and the upper cover 5 are all hingedly connected to the tail end of the support base 1 through the same pin shaft 9, consequently, as the upper cover 5 is pressed down, the force-applying arm of the upper cover 5 is long, and thereby the labor-saving effect is better.

The upper cover 5 is arranged in a plastic cover 11, and the support base 1 is fixed on a plastic base 12.

The structure of one side of the stapler is described above. In fact, the structures of both sides of the stapler are arranged symmetrically, that is, the other side of the stapler is symmetrically provided with the same structure.

When the stapler is in use, as the upper cover 5 is pressed down, the hinged shafts 10 of the front part of the hinge 4 can move toward the front part of the support base and get into the long notches 13, at this moment, the hinged shafts 10 of the rear part of the hinge 4 move in the other slots 14 of the upper cover 5 in a direction toward the tail of the upper cover, the upper cover 5 presses down the upper blade 3 by means of the hinge 4, and presses out a staple from staples in the staple pin track, and thereby the staple mounting act is completed.

When staples need to be mounted, the upper cover 5 is opened, the upper cover 5 drives the hinge 4 to move backward, consequently, the hinged shafts 10 of the front part of the hinge 4 get away from the notches 13 of the support base 1, so that the upper blade leaves the staple pin track 2, and therefore the staples can be mounted in the staple pin track.

Embodiment 3

Figure 7:
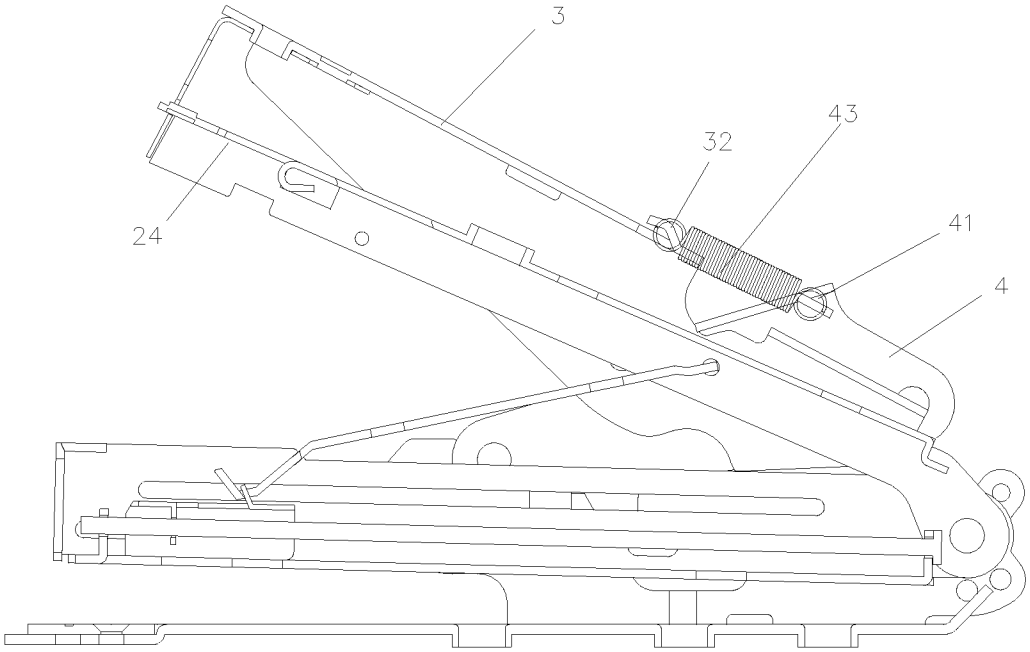
FIG. 7 is a schematic diagram of the sectional structure of embodiment 3 of the present invention.
Figure 8:
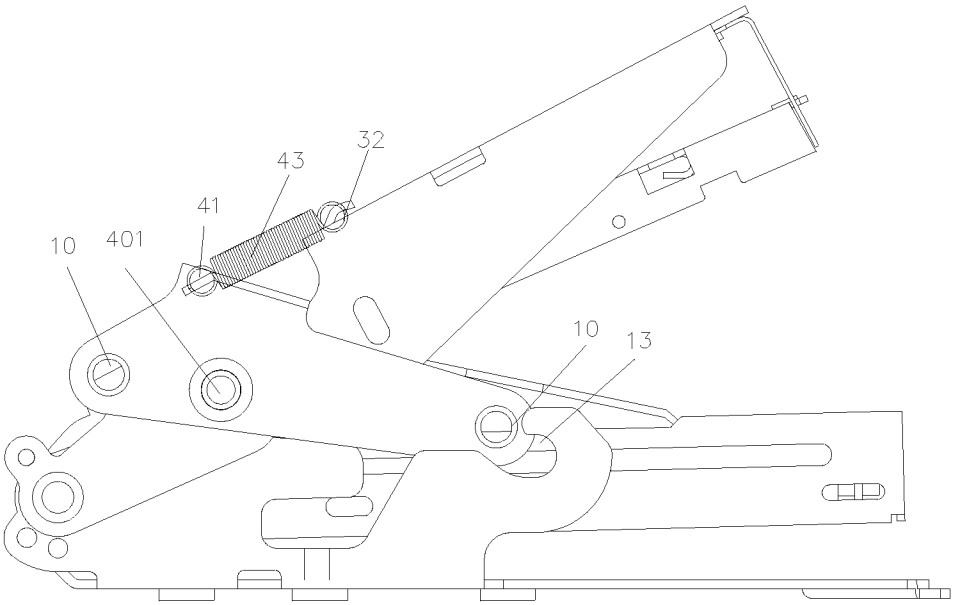
FIG. 8 is a schematic diagram of the side of embodiment 3 of the present invention.
Figure 9:
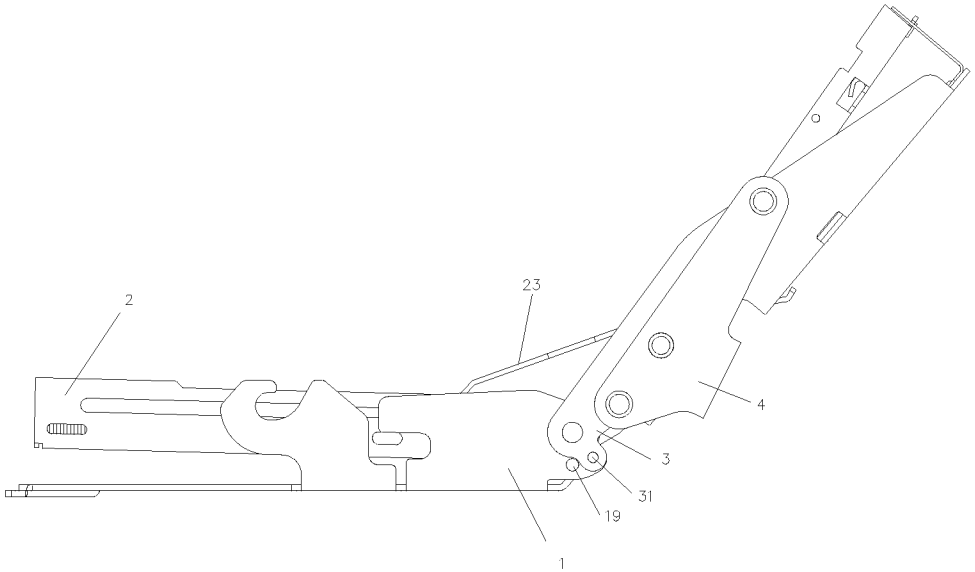
FIG. 9 is a structural schematic diagram when a staple-mounting mechanism of embodiment 4 of the present invention is in a staple-mounting ordinary state.
Figure 10:
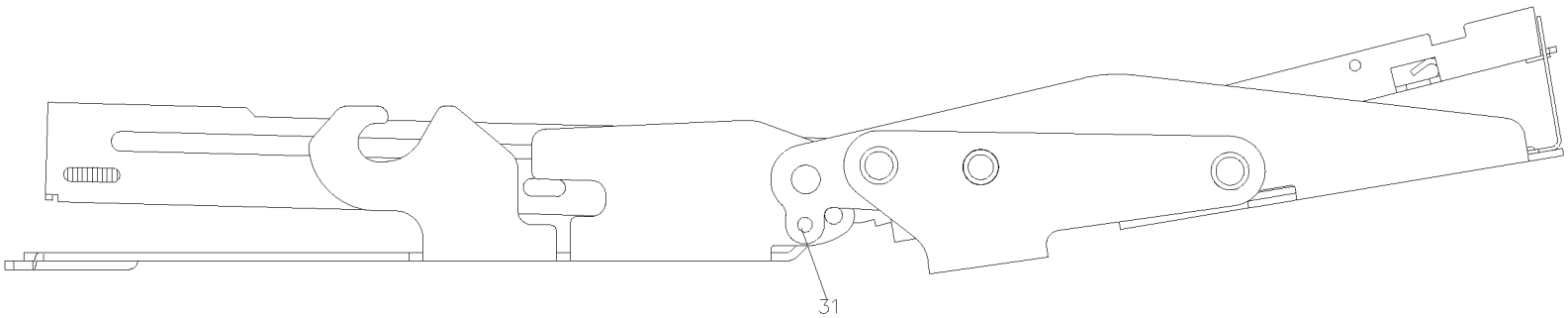
FIG. 10 is a structural schematic diagram when the staple-mounting mechanism of embodiment 4 of the present invention is in a staple-mounting positioning state.

As shown in FIG. 7 and FIG. 8, a front hinge-positioning portion 32 is provided in the middle part of the top blade 3, a rear hinge-positioning portion 41 is provided in the tail of the hinge 4, the ends of a tension spring 43 are respectively fixed between the front hinge-positioning portion 32 and the rear hinge-positioning portion 41, and the rest of the structure of the stapler is the same as that of embodiment 2.

When the stapler is in use, the hinge 4 is pressed down under the upper cover 5, the hinged shafts 10 of the rear part of the hinge 4 move backward in the first slide slots 14, the hinged shafts 10 of the front part of the hinge 4 can be just aimed at the openings of the straight notches 13 to get into the straight notches 13 under the action of the tension springs 43, and thereby the circumstance that the stapler cannot be used because the hinged shafts 10 of the front part of the hinge 4 cannot get into the straight notches 13 is prevented.

Embodiment 4

As shown in FIGS. 9-12, a staple-mounting mechanism comprises a top blade holder 3, an external staple pin track 2, an internal staple pin track 24, a staple pusher 21, a staple pusher spring 22, and a long pin 25; the long pin 25 is arranged in the external staple pin track 2, and is fixed at both ends of the external staple pin track; the staple pusher 21 sleeves the long pin 25, and is arranged in the external staple pin track 2; the rear end of the staple pusher 21 is connected to the front end of the staple pusher spring 22, the rear end of the staple pusher spring 22 is connected to the rear end of the staple pin track; staples 29 are mounted between the front end of the staple pusher 21 and the front end of the external staple pin track 2, the staple pusher 21 in the external staple pin track 2 is limited and pushed by the staple pusher spring 22 at the rear end of the staple pusher, and the staples 29 can be pushed out by the staple pusher.

The internal staple pin track 2 is connected to the staple pusher 21 through a connecting part 23, the staple pusher 21 is guided by the internal staple pin track 24 to move in the external staple pin track 2, the backward motion of the staple pusher 21 is stopped by the staple pusher spring 22, and the rear part of the external staple pin track 2 is connected to the support base 1 through a pin shaft 9.

The rest of the parts of the stapler are the same as that of embodiment 2.

The tail of the support base 1 is provided with a protruding 19, accordingly the tail of the top blade holder is provided with a hole 31, the protruding 19 of the tail of the support base 1 is inserted into the hole 31 of the tail of the upper blade holder, and thus a positioning mechanism is formed between the protruding and the small hole.

Of cause, a protruding or a similar part may also be provided in the tail of the top blade, a small hole or a similar part may also be provided in the tail of the support base, and a positioning mechanism is formed between the tail of the top blade and the tail of the support base.

Figure 11:
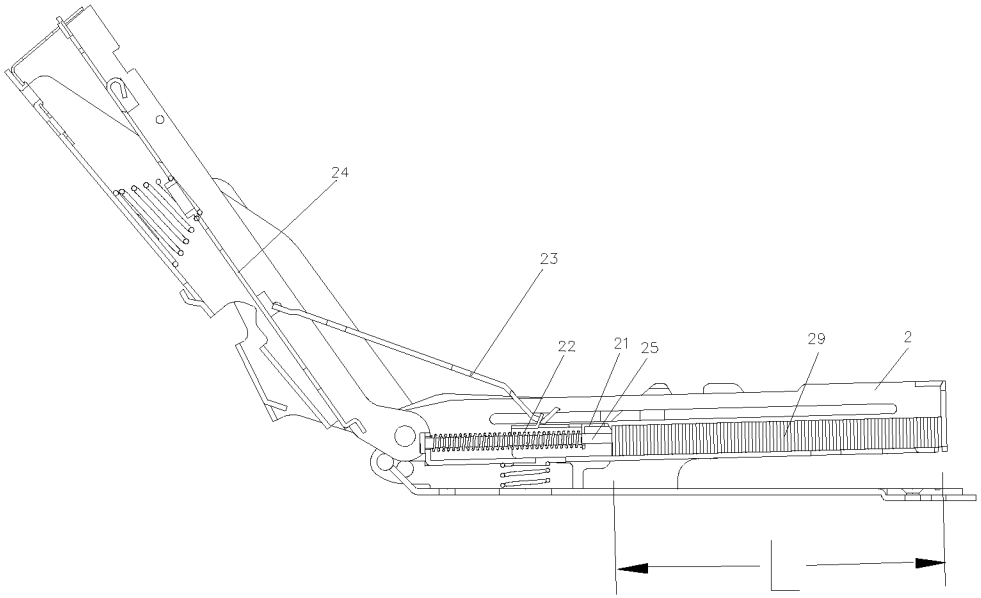
FIG. 11 is a sectional schematic diagram when the staple-mounting mechanism of embodiment 4 of the present invention is in the staple-mounting ordinary state.
Figure 12:
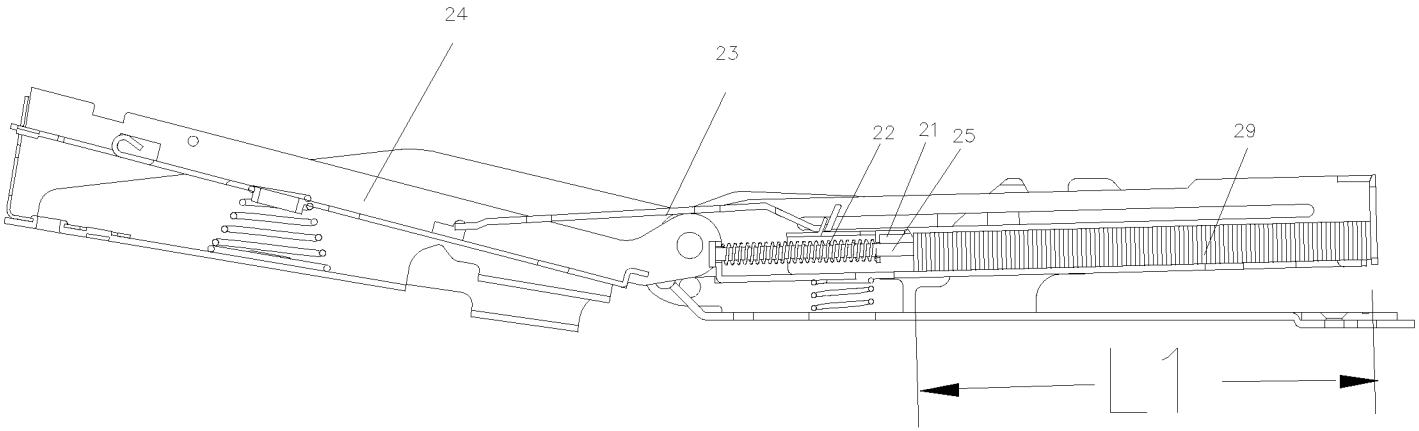
FIG. 12 is a sectional schematic diagram when the staple-mounting mechanism of embodiment 4 of the present invention is in the staple-mounting positioning state.

When the staples 29 need to be mounted, the top blade holder 3 is pulled upward to leave the external staple pin track 2, the top blade holder 3 moves the staple pusher 21 by means of the internal staple pin track 24 until the staple pusher spring 22 stops the staple pusher 21, see FIG. 11, and at this moment, the staple mounting length is L; when the tail of the top blade holder moves further forward to the maximum extension position, the protruding 19 of the tail of the support base 1 falls into the hole 31 of the tail of the top blade holder, the staple pusher 21 compresses the staple pusher spring 22 until the shortest distance, and at this moment, the staple mounting length is L1, which is notably greater than L, see FIG. 12, that is, more staples can be mounted.

What is claimed is:

1. A stapler, comprising:

a support base, a staple pin track, a top blade assembly, a hinge, and an upper cover; wherein tail ends of the staple pin track, the top blade assembly and the upper cover are all hingedly connected to a tail end of the support base;

a first guide part is-disposed on a side wall of the upper cover, wherein a first end of the hinge is slidably connected to the first guide part, the first guide part is set in a structure that when the upper cover is pressed, the first end of the hinge can move to the tail end of the upper cover and be pressed downward;

a second guide part disposed on a side wall of the support base, wherein a second end of the hinge is slidably connected to the second guide part, the second guide part is set in a structure that when the upper cover is pressed, the second end of the hinge can move to a front end of the support base, and wherein when the upper cover is opened, the second end of the hinge is separated from the support base; and a middle part of the hinge is hingedly connected to a middle part of the top blade assembly;

a hinge-positioning mechanism arranged between the hinge and the top blade assembly, wherein the second end of the hinge can be aimed at an opening of the second guide part, and thereby a front part of the second end of the hinge can be guided into the second guide part when the upper cover is closed.

2. The stapler according to claim 1, wherein the first guide part is closer to the tail end of the upper cover than to a front end of the upper cover.

3. The stapler according to claim 1, wherein the first guide part is a first slide slot, the first slide slot extends in a length direction of the upper cover, the length direction being the direction from the tail end of the upper cover to a front end of the upper cover, and the first end of the hinge is slidably connected into the first slide slot through a pin shaft.

4. The stapler according to claim 1, wherein the first guide part is a first slide slot, and the first end of the hinge is slidably connected into the first slide slot through a pin shaft.

5. The stapler according to claim 1, wherein the second guide part comprises a second slide slot and a third slide slot, the second slide slot extends in a direction parallel to a bottom surface of the support base, the third slide slot obliquely and downwardly extends from an upper end surface of the side wall of the support base and communicates with one end of the second slide slot which is closer to the tail end of the support base than another end of the second slide slot, an upper end of the third slide slot is open, an angle between the second slide slot and the third slide slot is obtuse, and the second end of the hinge is slidably connected into the second slide slot and the third slide slot through a hinge shaft.

6. The stapler according to claim 1, wherein the second guide part is a notch, the opening of which is directed to the tail end of the support base.

7. The stapler according to claim 1, wherein the hinge-positioning mechanism is as follows: a front hinge-positioning portion is provided in the middle part of the top blade assembly, a rear hinge-positioning portion is provided in a tail of the hinge, and one end of a tension spring is fixed at the front hinge-positioning portion and another end of the tension spring is fixed at the rear hinge-positioning portion.

8. The stapler according to claim 1, wherein a staple-mounting mechanism comprises the top blade assembly, an external staple pin track, an internal staple pin track, a staple pusher, a staple pusher spring, and a long pin;

the long pin is arranged in the external staple pin track, and is fixed at two ends of the external staple pin track; the staple pusher sleeves the long pin, and is arranged in the external staple pin track; a rear end of the staple pusher is connected to a front end of the staple pusher spring, a rear end of the staple pusher spring is connected to a rear end of the external staple pin track, staples are mounted between a front end of the staple pusher and a front end of the external staple pin track;

the internal staple pin track is connected to the staple pusher through a connecting part;

a positioning mechanism is arranged between a tail of the top blade assembly and the tail end of the support base, the top blade assembly is configured to leave the external staple pin track to mount the staples, and when the top blade assembly leaves from the external staple pin track to mount the staples until a maximum extension position, the top blade assembly and the support base are locked by the positioning mechanism.

9. The stapler according to claim 8, wherein the positioning mechanism is as follows: a protrusion or hole is provided in the tail of the support base, and a corresponding hole or protrusion is provided in the tail of the top blade assembly.

10. The stapler according to claim 1, wherein the tail ends of the staple pin track, the top blade assembly and the upper cover are all hingedly connected to the support base through a same pin shaft.

* * * * *